United States Patent [19]

Bernard et al.

[11] 4,258,339

[45] Mar. 24, 1981

[54] LUMPED CIRCUIT CIRCULATOR WITH ADJUSTABLE BAND WIDENING CIRCUIT

[75] Inventors: Nicolle Bernard; Jean-Rene Mahieu, both of Paris, France

[73] Assignee: Societe Lignes Telegraphiques et Telephoniques, Conflans-Ste. Honorine, France

[21] Appl. No.: 16,442

[22] Filed: Mar. 1, 1979

[30] Foreign Application Priority Data

Mar. 3, 1978 [FR] France ..... 78 06094

[51] Int. Cl.[3] ..... H01P 1/387

[52] U.S. Cl. ..... 333/1.1; 333/263

[58] Field of Search ..... 333/1.1, 263, 246

[56] References Cited

U.S. PATENT DOCUMENTS

| | | | |
|---|---|---|---|
| 3,085,212 | 4/1963 | Clark et al. | 333/1.1 |
| 3,605,040 | 9/1971 | Knerr et al. | 333/1.1 |
| 3,614,675 | 10/1971 | Konishi | 333/1.1 X |
| 3,836,874 | 9/1974 | Maeda et al. | 333/1.1 |
| 3,890,582 | 6/1975 | Jeong | 333/1.1 X |
| 4,174,506 | 11/1979 | Ogawa | 333/1.1 |

*Primary Examiner*—Paul L. Gensler

*Attorney, Agent, or Firm*—Kemon & Estabrook

[57] ABSTRACT

The band widening circuit consists of a section of microstrip with adjustable characteristic impedance connected in series with an adjustable capacitor both connected to the three interleaved conductive pattern of the circulator. The preferred mode consists of a microstrip with air as dielectric and a conductive plate movable with respect to the conductive strip in the shape of a spiral. The capacitor is a conductive plunger movable in a conductively coated recess of a substrate for the conductive strip of the microstrip line section.

4 Claims, 8 Drawing Figures

LUMPED CIRCUIT CIRCULATOR WITH ADJUSTABLE BAND WIDENING CIRCUIT

BACKGROUND OF THE INVENTION

The present invention concerns the design of lumped circuit circulators operating in a frequency band of the metric, decimetric or centimetric range.

French Pat. No. 2,185,896, filed on May 23, 1973, described a wideband circulator, which is illustrated in FIGS. 1A to 1C and which comprises an internal shield 11 surrounding two ferrite discs 10 a substrate 14 on which is deposited a printed circuit 15 forming the non reciprocal propagation medium, and two magnets 13 side of a printed circuit. Widening of the band is obtained by connecting shield 11, with a capacitance $C_s$ in relation to the ferrite discs, to three inductors $L'_s$ one end which is connected to casing 12, as illustrated in FIG. 1*b*. FIG. 1*c* illustrates the printed circuit composed of a central disc 16 which is in contact with shielf 11 and is connected to the three leads 17 constituting the inductances $L'_s$, each of which is terminated by a stud 18 which establishes the contact with the casing 12. The circuit disposed between the ferrite discs 10 is connected to the ports of the circulator.

The object of the present invention is to provide a lumped circuit circulator which comprises a continuously tunable band widening device.

BRIEF DISCLOSURE OF THE INVENTION

According to the invention a lumped circuit circulator comprises a band widening circuit consisting of a line stub in series with a capacitor, the characteristic impedance of the said line stub and the capacitance of the said capacitor being independently and continuously adjustable.

In one embodiment, the said line stub having adjustable characteristic impedance is a microstrip consisting of a conductive strip and a ground plane formed by the metal cover of the casing opposite said strip and the insulating air layer thickness is continuously adjusted by means of a screw tapping on the casing which is engaged in a screwthread of the cover. The capacitance of the capacitor is adjusted by displacement of a screwthreaded plunger core engaged in the screw tapping of the cover.

The circulator according to the invention has the advantage that it permits adjusting the pass bandwidth and matching it to the nominal values in the course of assembly. The cover and the plunger core at the potential of the casing are accessible from the outside through an opening in the yoke used for the setting-up operations and can be displaced without interrupting the operation of the circulator on a microwave measuring bench. After adjustment of the electrical characteristics, an electrically conductive bonding agent can be used to fix the adjustable components at the correct value.

The circular according to the invention comprises fewer parts and tolerates more dissymetry than the circulator of the prior art. More particularly, a single microstrip stub and a single ferrite disc are sufficient. The construction of the circulator according to the invention thus appears to be more economical than that of circulators according to the prior art.

BRIEF DESCRIPTION OF THE FIGURES

The invention will be more readily understood from the following description accompanied by FIGS. 1 to 6 which are given purely by way of non limiting illustration and in which.

DETAILED DESCRIPTION

Figure 1A:
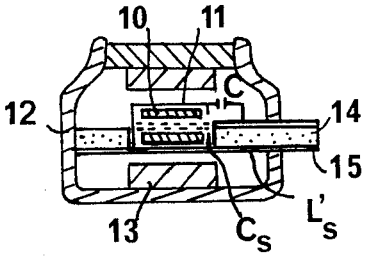
FIG. 1*a* is a sectional view of the circulator according to the prior art.
Figure 1B:
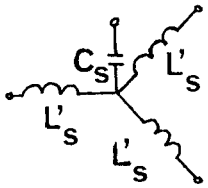
FIG. 1*b* illustrates the circuit equivalent to the device for widening the pass band of the circulator according to the prior art.
Figure 1C:
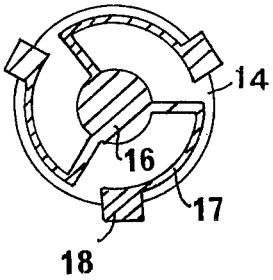
FIG. 1*c* is an underneath view of a part of the device for widening the band of the circulator according to the prior art.

FIGS. 1*a*, 1*b* and 1*c* have already been described in the foregoing.

Figure 2:
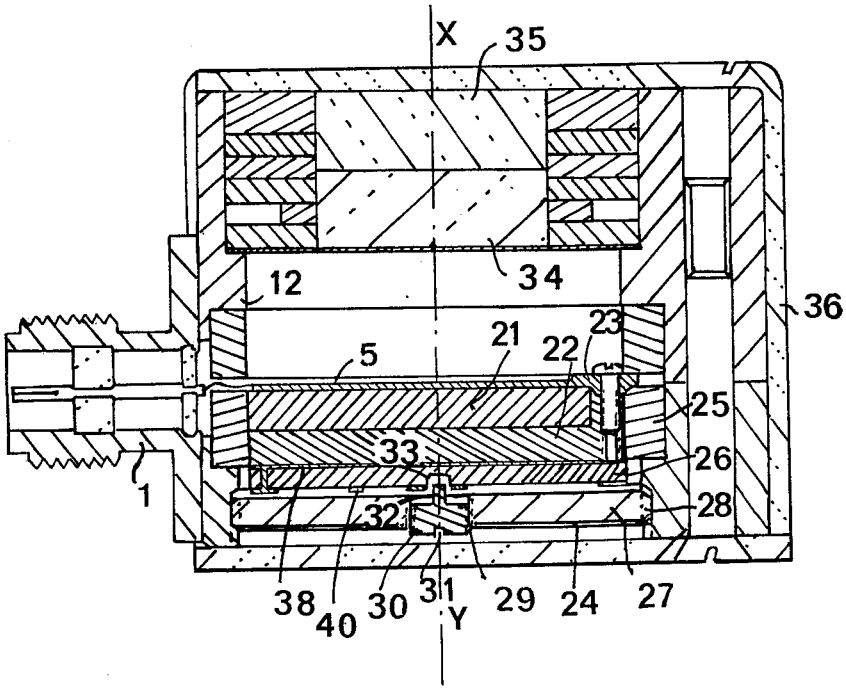
FIG. 2 is a sectional view of the circulator according to the invention.
Figure 4:
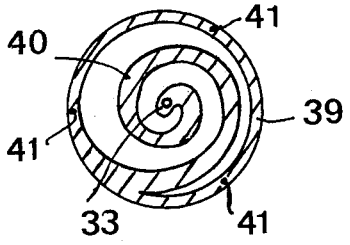
FIG. 4 illustrates the narrow conductor of the microstrip line section incorporated in the band widening device.

FIG. 2 is a sectional view of the circulator according to the invention, taken through the plane of symmetry of the coaxial port 1. The coaxial port 1 is fixed on a metal casing 12 having an internal cylindrical recess of axis X-Y and a disc-shaped cover 27 of like axis. The inner lead of the coaxial port 1 is connected to a first end of a metal strip 5 deposited on ferrite disc 21. The ports 2 and 3 oriented at 120 degrees in relation to the port 1 are connected in the same way to the first ends of two other metal strips at 120 degrees to one another. The three interleaved strips are in contact with a metal plate 22 as is shown at 23. The metal plate 22 is maintained in position within metal casing 12 by an insulating cylinder 25. The lower part of plate 22 is in contact with the metallized face 38 of a printed circuit substrate 26, of which the second face, which will hereinafter be described with reference to FIG. 4, carries a conductive strip 40. The metal cover 27, which has a screwthread 28 engaged in the screw tapping on the casing 12 and a diametral slot 24 in its external face, moves towards or away from the substrate 26 when a rotation is imparted thereto by means of a screwdriver engaged in the slot 24. In addition, a screw tapped aperture 29 of axis X-Y receives a plunger core 30 screwthreaded into the screw tapping 29, so as to move along the axis X-Y on rotation by means of a screwdriver engaged in a slot 31. The plunger core 30 has a cylindrical pin 32 engaging in a metallized hole 33 through strip 40. The cover 27 and the plunger core 30 are held fast in the position corresponding to the optimum adjustment by means of an electrically conductive bonding agent. A continuous magnetizing field perpendicular to the ferrite disc 21 is created by a magnet consisting of magnetized discs 34 and 35 and an iron yoke 36.

Figure 3:
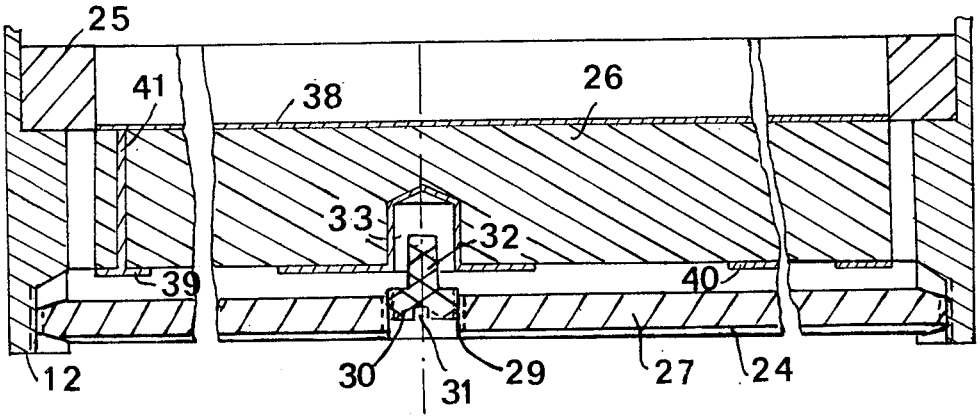
FIG. 3 is a sectional view, drawn to a larger scale, of the band widening device according to the invention.

FIG. 3 is a sectional view, drawn to a larger scale, of the bank widening circuit of the circulator according to the invention. This circuit is composed of the strip 40, the metal cover 27 and the plunger core 30. Strip 40, which is outwardly limited by ring 39 (cf. FIG. 4), consists of a spiral of a few turns which is deposited on an insulating substrate 26. Conductive ring 39 is connected to the upper metallisation 38 by three internally metallized through holes 41 disposed at 120 degrees. Strip 40 and the metal cover 27 constitute a microstrip section with air as dielectric. The characteristic impedance of this propagation line section is adjusted by changing the distance between the spiral 40 and the metal cover 27. A first end of the line section is connected by way of the ring 39, the three metallized holes 41 and the metallisation 38 to the metal plate 22 serving as common return for the three interleaved lines 5 formed by metallisation on the ferrite disc 21. The second end of the microstrip line section is connected to the adjustable capacitor formed between 32 and 33 by way of a metallized hole 33 which is in contact with the central end of the spiral 40.

Figure 5:
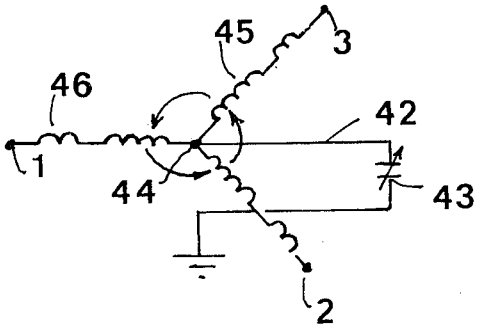
FIG. 5 is the electrical circuit diagram of the circulator according to the invention.

FIG. 5 illustrates the equivalent circuit of the circulator. The microstrip line section formed by the spiral 40 and the metal cover 27 is denoted by 42. The adjustable capacitor 32–33 is denoted by 43. The metallisation 38 and the metal plate 22 form in series a lead 44 common to inductances 45 corresponding to the mutual coupling equivalent to the non reciprocal ferrite. The inductances 46 represent a parasitic term permitting reciprocal propagation beteen the ports 1, 2 and 3 of the circulator.

Figure 6:
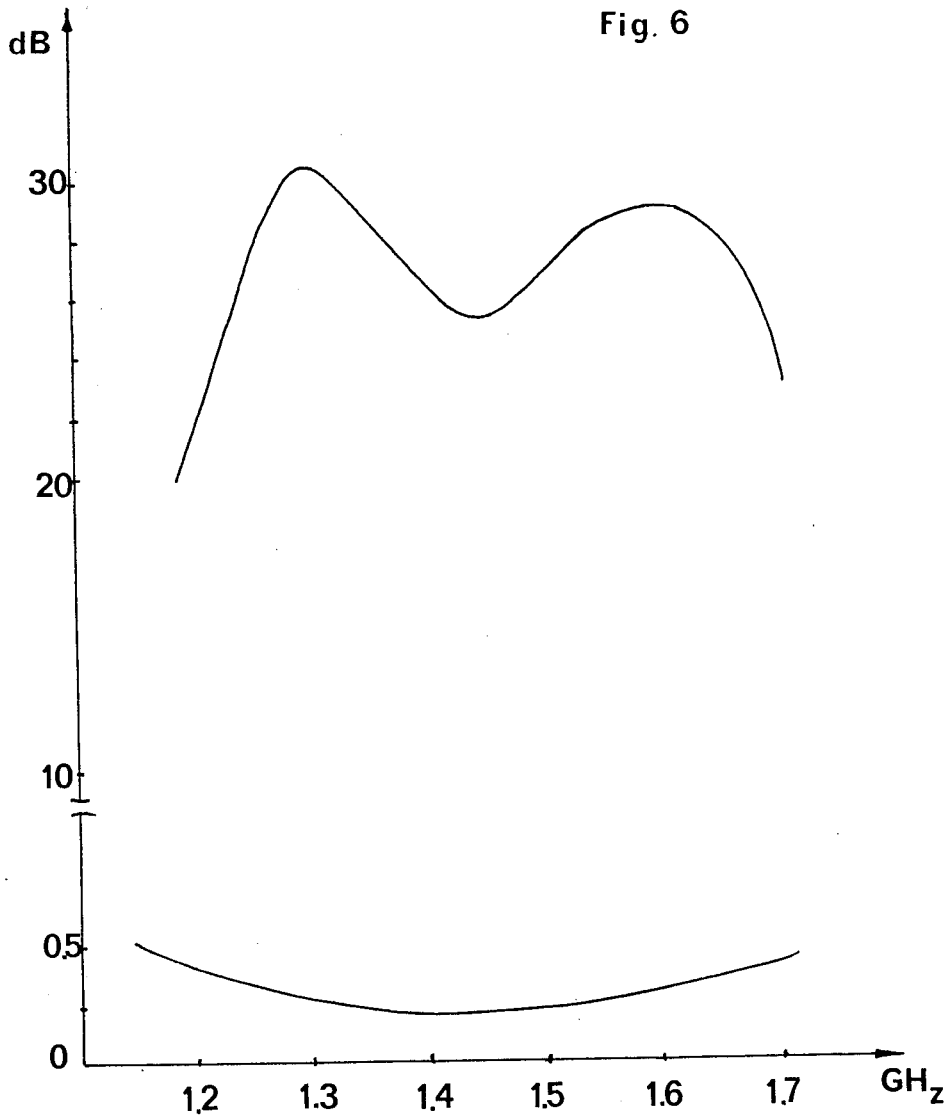
FIG. 6 shows the curves of the decoupling and the insertion loss, respectively, of a circulator according to the invention.

By way of the non limiting illustrative example, a circulator operating in the frequency band between 1.2 and 1.7 GHz has been designed which has an insertion loss lower than 0.4 dB and a decoupling higher than 20 dB, as illustrated in FIG. 6, consisting of: a garnet disc having a diameter equal to 16 millimeters and a thickness equal to 1.7 millimeters, to which there have been applied by metallisation three interleaved lines oriented at 120 degrees to one another;

a printed circuit 26–40 having a diameter equal to 16 millimeters and a thickness equal to 1.2 millimeters which has on one of its faces a continuous metal coating 38 and on the other fact strip 40 and annulus 39 having an external diameter equal to 16 millimeters and an internal diameter equal to 1.4 millimeters, strip 49 is a two turn spiral which is formed of a flat conductor of a width of 1.5 millimeters which has at its centre a metallized hole 33 which is 0.5 millimeter in diameter and 0.6 millimeter in height;

a metal cover 27 consisting of AU 4 G alloy, having an external diameter equal to 18 millimeters;

a brass plumger core 30 formed as an external head equal to 3 millimeters in diameter and a pin 32 having a diameter equal to 0.4 millimeter and a height equal to 0.8 millimeter.

FIG. 6 shows the curve representing the decoupling between ports and the curve representing the insertion loss in the band of the circulator just described. As shown in the band 1.2 to 1.7 GHz, the insertion loss remains below 0.5 dB (lower curve) and the decoupling is at least 20 dB and over 25 dB in the 1.23 to 1.68 GHz band.

What we claim:

1. A lumped circuit circulator comprising:

a nonreciprocal gyromagnetic disc;

a microstrip circuit on said disc;

three coaxial ports electrically connected to said microstrip circuit;

means for establishing a d.c. magentizing field in said disc;

a printed circuit having a recess centrally provided in the lower face thereof;

a metallic member positioned between said disc and said printed circuit to function as a ground plane;

a metallic casing housing said circulator; and an adjustable band widening circuit including:

a strip line circuit deposited on said lower face of said printed circuit, said strip line circuit having a central metallized part surrounding said recess;

movable metallic cover means threadedly connected to one end of said casing for adjustment with respect thereto, said cover means having a centrally located threaded bore; and a movable plunger disposed in said threaded bore, said plunger extedning into said recess in said printed circuit.

2. A circulator as claimed in claim 1, wherein said casing is cylindrical and in electrical contact with the external conductor of each of said coaxial ports;

said printed circuit having a metallized layer deposited on the upper face thereof;

said metallic member having one side locked by an insulating sleeve into contact with said metallized layer and said gyromagnetic disc being locked on the other side of said metallic member.

3. A circulator as claimed in claim 2, wherein said strip line circuit is a conductive ring surrounding a conductive spiral with the innermost end of said spiral surrounding said recess in saidprinted circuit.

4. A circulator as claimed in claim 3, wherein said movable plunger and said metallized recess in said printed circuit together constitute an adjustable discrete capacitor.

* * * * *